US007366438B2

(12) United States Patent
Takeuchi et al.

(10) Patent No.: US 7,366,438 B2
(45) **Date of Patent: *Apr. 29, 2008**

(54) IMAGE FORMING APPARATUS WHICH CAN OPTIMIZE CLEANING TIME OF TRANSFER MEMBER CONTACTING INTER-IMAGE AREA OF IMAGE BEARING MEMBER

(75) Inventors: Yasushi Takeuchi, Toride (JP); Yuichi Ikeda, Abiko (JP); Jun Tomine, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/735,759

(22) Filed: Apr. 16, 2007

(65) Prior Publication Data

US 2007/0183801 A1 Aug. 9, 2007

Related U.S. Application Data

(62) Division of application No. 11/149,540, filed on Jun. 10, 2005, now Pat. No. 7,242,887.

(30) Foreign Application Priority Data

Jun. 17, 2004 (JP) ..... 2004-180228

(51) Int. Cl.
*G03G 15/16* (2006.01)

(52) U.S. Cl. ..... 399/101; 399/66

(58) Field of Classification Search ..... 399/49, 399/66, 71, 98, 101, 302, 308, 313
See application file for complete search history.

(56) References Cited

U.S. PATENT DOCUMENTS 5,337,127 A 8/1994 Imaue (Continued)

FOREIGN PATENT DOCUMENTS

JP 4-120560 4/1992

(Continued)

OTHER PUBLICATIONS

Patent Abstracts of Japan, Publication No. 04120560, Apr. 21, 1992.
Patent Abstracts of Japan, Publication No. 2003248361, Sep. 5, 2003.

*Primary Examiner*—Sandra L. Brase
(74) *Attorney, Agent, or Firm*—Fitzpatrick, Cella, Harper & Scinto

(57) ABSTRACT

An image forming apparatus includes an image bearing member; a toner image forming section for forming toner images on the image bearing member, whereby the toner image forming section forms a detection patch on the image bearing member; a transfer member for contacting the image bearing member to form a transfer nip portion, and electrically transferring the toner image to the recording material in the transfer nip portion; a detector for detecting the detection patch; a controller for variably controlling a toner image forming condition based on the detection result of the detector; and a toner removing section for forming a cleaning electric field to remove toner adhering to the transfer member when the inter-toner image area passes through the transfer nip portion. The electric field electrostatically moves the toner adhering to the transfer member to the image bearing member. A length of time of the electric field formed after the detection patch has passed through the transfer nip portion in a time period when the inter-toner image area on which the detection patch is formed passes through the transfer nip portion, is longer than a length of time of the electric field formed in a time period when the inter-toner image area on which the detection patch is not formed passes through the transfer nip portion.

4 Claims, 16 Drawing Sheets

U.S. PATENT DOCUMENTS

| | | | | |
|---|---|---|---|---|
| 5,621,509 | A | 4/1997 | Karashima et al. | 399/46 |
| 5,729,788 | A | 3/1998 | Hirohashi et al. | 399/66 |
| 5,822,649 | A | 10/1998 | Karashima et al. | 399/66 |
| 5,890,030 | A | 3/1999 | Namekata et al. | 399/66 |
| 6,173,135 | B1 | 1/2001 | Yuminamochi et al. | 399/66 |
| 6,341,205 | B1 | 1/2002 | Yoshino et al. | 399/101 |
| 7,242,887 | B2 * | 7/2007 | Takeuchi et al. | 399/101 |
| 2006/0104653 | A1 | 5/2006 | Yamamoto et al. | 399/71 |

FOREIGN PATENT DOCUMENTS

| | | |
|---|---|---|
| JP | 8-314297 | 11/1996 |
| JP | 2000-147914 | 5/2000 |
| JP | 2002-55543 | 2/2002 |
| JP | 2003-84582 | 3/2003 |
| JP | 2003-248361 | 9/2003 |
| JP | 2003-302798 | 10/2003 |

* cited by examiner

IMAGE FORMING APPARATUS WHICH CAN OPTIMIZE CLEANING TIME OF TRANSFER MEMBER CONTACTING INTER-IMAGE AREA OF IMAGE BEARING MEMBER

CROSS-REFERENCE TO RELATED APPLICATION

This application is a divisional of application Ser. No. 11/149,540, filed Jun. 10, 2005 now U.S. Pat. No. 7,242,887.

BACKGROUND OF THE INVENTION

1. Field of the Invention

The present invention relates to removal of toner adhering to a transfer member, in an image forming apparatus in which a detection toner image is formed in an inter-image area between toner images formed repeatedly in an image bearing member, and in the image forming apparatus in which a transfer member contacting the image bearing member to transfer the toner image on the image bearing member to a recording material contacts the inter-image area of the image bearing member.

2. Related Background Art

Recently, demand for stabilization of image quality is increasing in an electrophotographic image forming apparatus. Therefore, in forming repeatedly the plural toner images on the image bearing member, the detection toner image is formed in the inter-image area between the toner images on the image bearing member to increase a frequency of control of toner image forming conditions based on the detection result of the detection toner image, and thereby the stabilization of the image quality is achieved.

On the other hand, when the toner image on the image bearing member is transferred to the recording material, the transfer member being in contact with the image bearing member is also in contact with the inter-image area where the toner image transferred to the recording material does not exist. Therefore, generation of vibration caused by contacting and separating the transfer member to and from the image bearing member can be prevented to narrow the inter-image area, and the number of images formed per unit time can be increased in the image forming apparatus When the transfer member is in contact with the inter-image area, a fog toner or the detection toner image adheres to the transfer member in the inter-image area. In order to remove the adhesion toner, a cleaning electric field is formed while the transfer member is in contact with the inter-image area. The cleaning electric field causes the toner adhering to the transfer member to be electrostatically moved to the image bearing member.

However, because the toner removal from the transfer member to which the detection toner image adheres is not sufficiently performed, there is generated a problem that the toner adheres to the recording material surface with which the transfer member is in contact.

SUMMARY OF THE INVENTION

In view of the foregoing, an object of the invention is to provide an image forming apparatus which can decrease the amount of toner adhesion to the surface, where the recording material contacts the transfer member, by sufficiently remove the toner of the detection toner image adhering to the transfer member contacting the inter-image area.

Another object of the invention is to provide an image forming apparatus including a movable image bearing member; toner image forming means for repeatedly forming plural toner images in the image bearing member; detection toner image forming means for forming a detection toner image in an inter-image area between the toner image and the toner image on the image bearing member; a transfer member which is in contact with an area in the image bearing member through intervention of a recording material, the toner image being formed in the area, the transfer member being in contact with the inter-image area with no recording material, the transfer member electrostatically transferring the toner image formed in the image bearing member to the recording material; detecting means for detecting the detection toner image on the image bearing member; controlling means for variably controlling a toner image forming condition of the toner image forming means based on the detection result; and toner removing means for forming a cleaning electric field to remove toner adhering to the transfer member, the cleaning electric field electrostatically moving the toner adhering to the transfer member to the image bearing member while the transfer member is in contact with the inter-image area, wherein, letting a time when the toner removing means forms the cleaning electric field be T1 in the case where the detection toner image is formed prior to the formation of the cleaning electric field in the inter-image area with which the transfer member is in contact, and letting a time when the toner removing means forms the cleaning electric field is T2 in the case where the detection toner image be not formed in the inter-image area with which the transfer member is in contact, T1 is longer than T2.

DETAILED DESCRIPTION OF THE PREFERRED EMBODIMENTS

In an embodiment according to the invention, a time when the toner removing means forms the cleaning electric field is set at T1 in the case where the detection toner image is formed prior to the formation of the cleaning electric field in the inter-image area with which a secondary transfer roller 26 (transfer member) is in contact, and a time when the toner removing means forms the cleaning electric field is set at T2 in the case where the detection toner image is not formed in the inter-image area with which the secondary transfer roller 26 (transfer member) is in contact, letting T1>T2, the detection toner image adheres to the secondary transfer roller 26 (transfer member), and the toner can sufficiently be removed even if the amount of toner adhering to the recording material is increased, which results in solution of the problem that the toner adheres to the recording material surface with which the secondary transfer roller 26 (transfer member) is in contact.

Namely, the amount of toner per unit area of the detection toner image is larger than the amount of toner per unit area of the fog toner. Therefore, the time when the cleaning electric field is formed in order to remove the fog toner is set longer than the time when the cleaning electric field is formed in order to remove the toner of the detection toner image, which allows the detection toner image adhering to the secondary transfer roller 26 (transfer member) to be sufficiently removed.

Preferred embodiments of the invention will be described blow below.

First Embodiment

Figure 1:
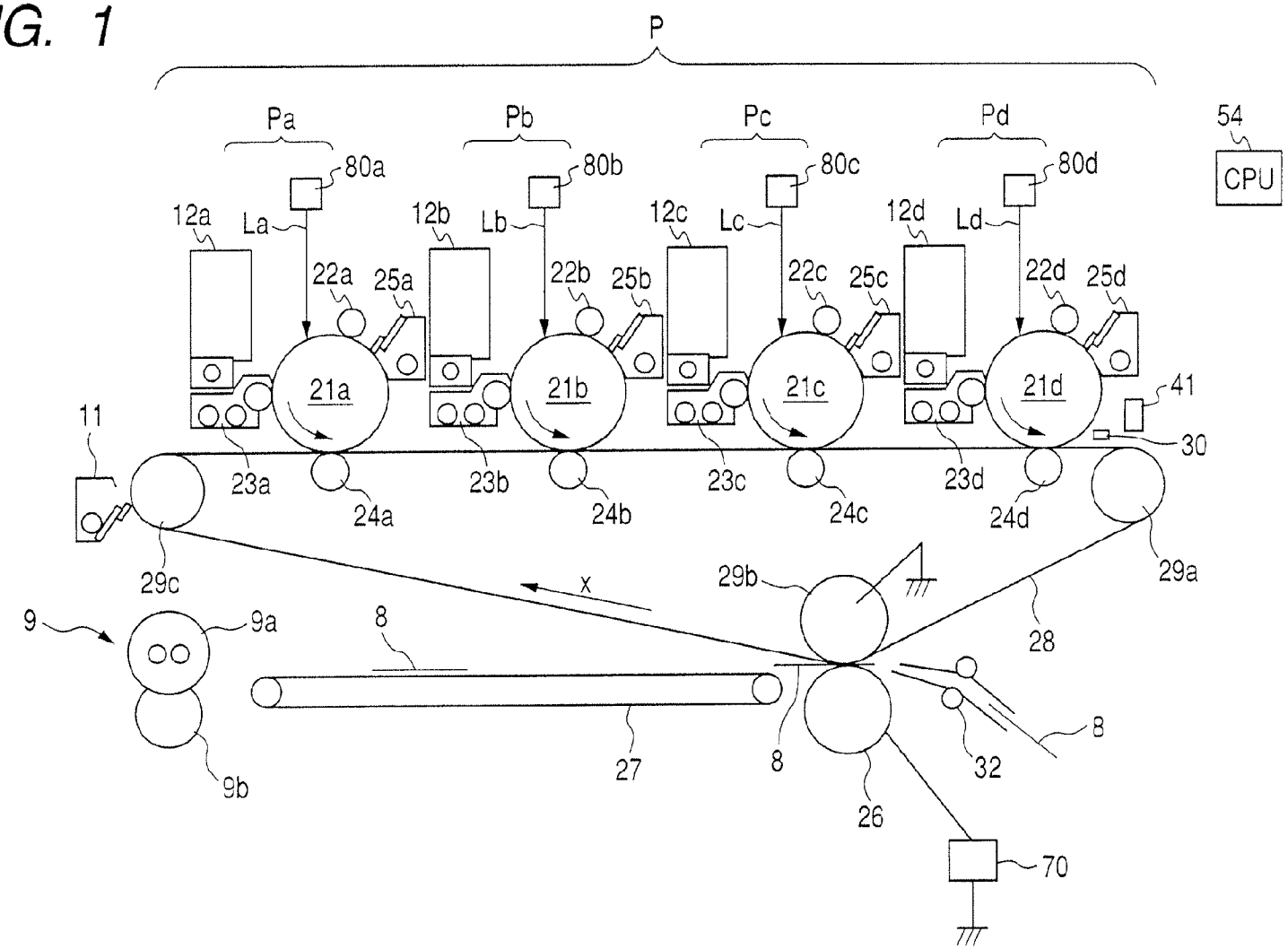
FIG. 1 is an entire block diagram showing an embodiment of an image forming apparatus of the invention.

The invention can be implemented in an electrophotographic type color image forming apparatus shown in FIG. 1. Therefore, referring to FIG. 1, the electrophotographic type color image forming apparatus which is of an embodiment of the image forming apparatus of the invention will be described in detail.

In the image forming apparatus of the first embodiment, an intermediate transfer member which is of the image bearing member includes an endless intermediate transferring belt 28 entrained about support rollers 29*a*, 29*b*, and 29*c*. The intermediate transferring belt 28 runs in an arrow X direction in a main body. The intermediate transferring belt 28 is formed by a dielectric resin film made of polycarbonate, polyethylene terephthalate, polyvinylidene fluoride, and the like. A recording material 8 taken from a sheet feeding cassette (not shown) is conveyed to a secondary transfer region of the intermediate transferring belt 28 through a registration roller 32.

An image forming portion P which is of the four toner image forming means is linearly arranged above the intermediate transferring belt 28. The image forming portion P is formed by four parts Pa, Pb, Pc, and Pd. The four parts Pa, Pb, Pc, and Pd constituting the image forming portion P substantially have the same configuration. The four parts Pa, Pb, Pc, and Pd differ from one another only in that the magenta, cyan, yellow, or black toner image is formed.

The four parts Pa, Pb, Pc, and Pd constituting the image forming portion P include a photosensitive drum 21 (21*a*, 21*b*, 21*c*, and 21*d*) which is rotatably arranged. In the first embodiment, process instruments are arranged around the photosensitive drum 21 (21*a*, 21*b*, 21*c*, and 21*d*). The process instruments include a contact charging apparatus 22 (22*a*, 22*b*, 22*c*, and 22*d*) which is of charging means, an exposing apparatus 80 (80*a*, 80*b*, 80*c*, and 80*d*) which is of exposing means, a developing apparatus 23 (23*a*, 23*b*, 23*c*, and 23*d*) which is of developing means, cleaning apparatus 25 (25*a*, 25*b*, 25*c*, and 25*d*) which is of cleaning means, and the like. The exposing apparatus 80 exposes the charged photosensitive drum 21 with a laser beam L (La, Lb, Lc, and Ld) to form an electrostatic latent image. The magenta toner, cyan toner, yellow toner, and black toner are stored in the developing devices 23*a*, 23*b*, 23*c*, and 23*d*of the four parts Pa, Pb, Pc, and Pd constituting the image forming portion respectively. The magenta toner, cyan toner, yellow toner, and black toner are charged in negative polarity.

The photosensitive drum 21*a*is evenly charged in the negative polarity by the contact charging apparatus 22*a*. A laser beam is projected onto the photosensitive drum 21*a* charged in the negative polarity through a polygon mirror (not shown), and the electrostatic latent image is formed on the photosensitive drum 21*a*. The laser beam has image signals of magenta component color of an original. The magenta toner charged in the negative polarity is supplied from the developing apparatus 23*a* to develop the electrostatic latent image, and the electrostatic latent image is visualized as the magenta toner image. When the magenta toner image reaches a primary transfer region where the photosensitive drum 21*a* and the intermediate transferring belt 28 abut on each other according to the rotation of the photosensitive drum 21*a*, the magenta toner image on the photosensitive drum 21*a* is transferred to the intermediate transferring belt 28 by a primary transfer bias having positive polarity applied to a primary transfer roller 24 (24*a*, 24*b*, 24*c*, and 24*d*) which is of primary transferring means (primary transfer).

The photosensitive drum 21*a* is evenly charged in the negative polarity by the contact charging apparatus 22*a*. A laser beam is projected onto the photosensitive drum 21*a* charged in the negative polarity through a polygon mirror (not shown), and the electrostatic latent image is formed on the photosensitive drum 21*a*. The laser beam has image signals of magenta component color of an original. The magenta toner charged in the negative polarity is supplied from the developing apparatus 23*a* to develop the electrostatic latent image, and the electrostatic latent image is visualized as the magenta toner image. When the magenta toner image reaches a primary transfer region where the photosensitive drum 21*a* and the intermediate transferring belt 28 abut on each other according to the rotation of the photosensitive drum 21*a*, the magenta toner image on the photosensitive drum 21*a* is transferred to the intermediate transferring belt 28 by a primary transfer bias having positive polarity applied to a primary transfer roller 24*a* which is of primary transferring means (primary transfer).

When the region which bears the magenta toner image in the intermediate transferring belt 28 is moved to image forming portion Pb, as with the magenta toner image, the cyan toner image is formed on the photosensitive drum 21*b* in the image forming portion Pb, and the cyan toner image is transferred to the intermediate transferring belt 28 while superposed on the magenta toner image. At this point, as with the image forming portion Pa, the charging and the bias application are also performed in the image forming portion Pb, and the cyan toner image is formed and transferred to the intermediate transferring belt 28. In the image forming portions Pc and Pd (described below), similarly the charging and the bias application are performed, and the yellow toner image and the black toner image are formed and transferred to the intermediate transferring belt 28.

As with the magenta toner image and cyan toner image which are transferred to the intermediate transferring belt 28, in each primary transfer region of the image forming portions Pc and Pd, the yellow toner image and the black toner image are transferred while superposed on the magenta toner image and the cyan toner image as the intermediate transferring belt 28 is moved. At the same time, the recording material 8 from the sheet feeding cassette reaches the secondary transfer region through the registration roller 32. The four-color toner images on the intermediate transferring belt 28 are transferred onto the recording material 8 in a collective manner by a secondary transfer bias having the positive polarity applied to the secondary transfer roller 26 which is secondary transferring means (secondary transfer). The secondary transfer roller 26 is conductive, formed by a sponge rubber roller. At this point, the secondary transfer bias is applied to the secondary transfer roller 26 from a power supply 70. The support roller 29*b* is electrically grounded. The support roller 29*b* is provided opposite the secondary transfer roller 26 through the intermediate transferring belt 28.

The secondary transfer residual toner after the secondary transfer and the toner discharged by cleaning action of the secondary transfer roller 26 are cleaned by the cleaning apparatus 11 attached onto the intermediate transferring belt 28 to prepare the next image formation. The cleaning apparatus 11 of the first embodiment adopts a blade cleaning method in which urethane rubber is pressured by a spring with a predetermined abutting pressure.

Finally, the recording material 8 to which the four-color toner images are transferred is separated from the intermediate transferring belt 28, and then the recording material 8 is conveyed to a fixing apparatus 9 by the conveying belt 27. In the fixing apparatus 9, heat and pressure are applied to the recording material 8 with a pair of rollers 9*a* and 9*b* to fix the toner images onto the recording material 8.

Figure 2:
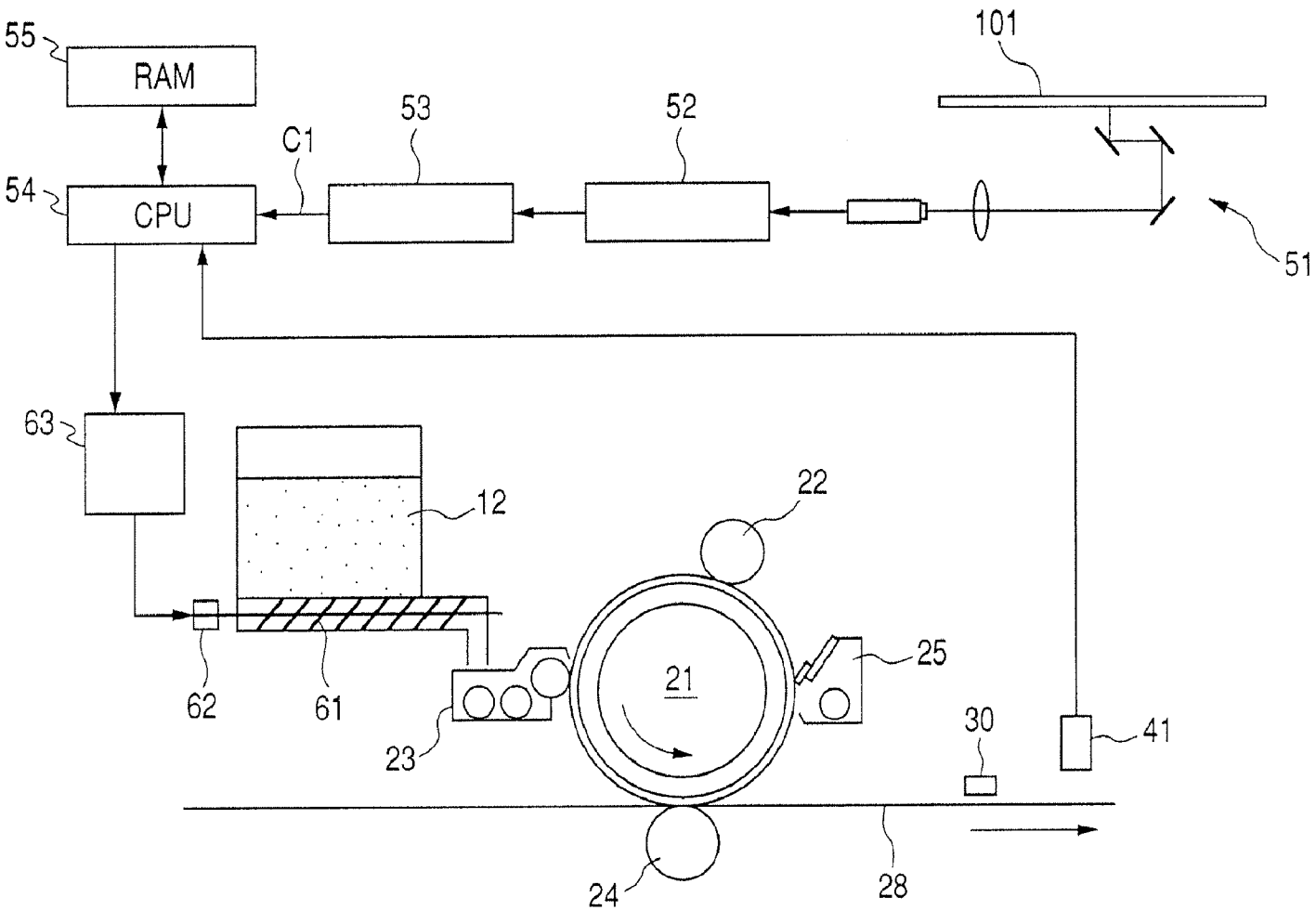
FIG. 2 is a schematic view explaining an embodiment of toner replenishment control of the image forming apparatus of the invention.

In the image forming apparatus of the first embodiment, a two-component developer in which the toner and carrier are mixed with each other is used for the developing apparatus 23. In the developing apparatus 23 in which the two-component developer is used like the first embodiment, it is necessary that a mixture ratio T/D (D=T+C) of the toner (T) to the carrier (C) in the developer is kept constant. The mixture ratio T/D is toner density of the developer (hereinafter, referred to as T/D ratio). Therefore, toner replenishment control (ATR) which keeps the T/D ratio constant is performed. Referring to FIGS. 1 and 2, the toner replenishment control in the first embodiment will be described below.

As shown in FIG. 2, in the first embodiment, an original 101 to be copied is projected by a reader portion 51, the original image is divided into many pixel portions, and a photoelectric conversion signal corresponding to the density of each pixel is outputted. The output from the reader portion 51 is transmitted to an image signal processing circuit 52. The image signal processing circuit 52 forms a pixel image signal having an output level corresponding to the density of each pixel.

In order to control the amount of toner with which the developing apparatus 23 is replenished by a video counter mode, the output signal level of the image signal processing circuit 52 is counted in each pixel and integrated by a video counter 53. An integrated value C1 in which the output signal is integrated in each pixel corresponds to the amount of toner consumed in the developing apparatus 23 for forming one image (toner image) of the original 101.

The integrated value C1 is stored in RAM 55 while transmitted to CPU 54. CPU 54 computes a rotating drive time of a conveying screw 61, which is necessary to supply the amount of toner equal to the amount of toner consumed in the developing apparatus 23 from a hopper 12 (12*a*, 12*b*, 12*c*, and 12*d*) to the developing apparatus 23, based on the integrated value C1. Then, CPU 54 controls a drive circuit 63 of a motor 62 to drive the motor 62 for the computed rotating drive time, and the toner replenishment is performed.

However, when the T/D ratio control is performed only by the video count mode ATR, toner states such as flow behavior and bulk density are changed by humidity or a standing state to generate a fluctuation in replenishment accuracy of the toner hopper which performs the toner replenishment. As a result, the toner replenishment is not successfully performed for the predicted consumption amount, and the T/D ratio is gradually fluctuated. Therefore, a patch detection mode ATR is performed. In the patch detection mode ATR, the fluctuation in T/D ratio is corrected by periodically forming a patch image (toner pattern image) as the detection toner image on the intermediate transferring belt 28 to determine the actual toner density of the developer in the developing apparatus 23.

According to the first embodiment, as shown in FIG. 2, the video count mode ATR is formed by combining the reader portion 51 and the video counter 53. Further, the patch detection mode ATR is formed while including a density detection sensor 41 (detecting means) 41 which detects the density by irradiating the toner patch image which becomes a reference image with a light source such as LED to detect the light reflected from the toner patch image with a light-reception device such as a photodiode. As can be seen from FIG. 1, in the first embodiment, the density detection sensor 41 is arranged at a position of the intermediate transferring belt support roller 29*a*. The support roller 29*a* is located on the upstream side of the secondary transfer roller 26 on the intermediate transferring belt 28.

Figure 3:
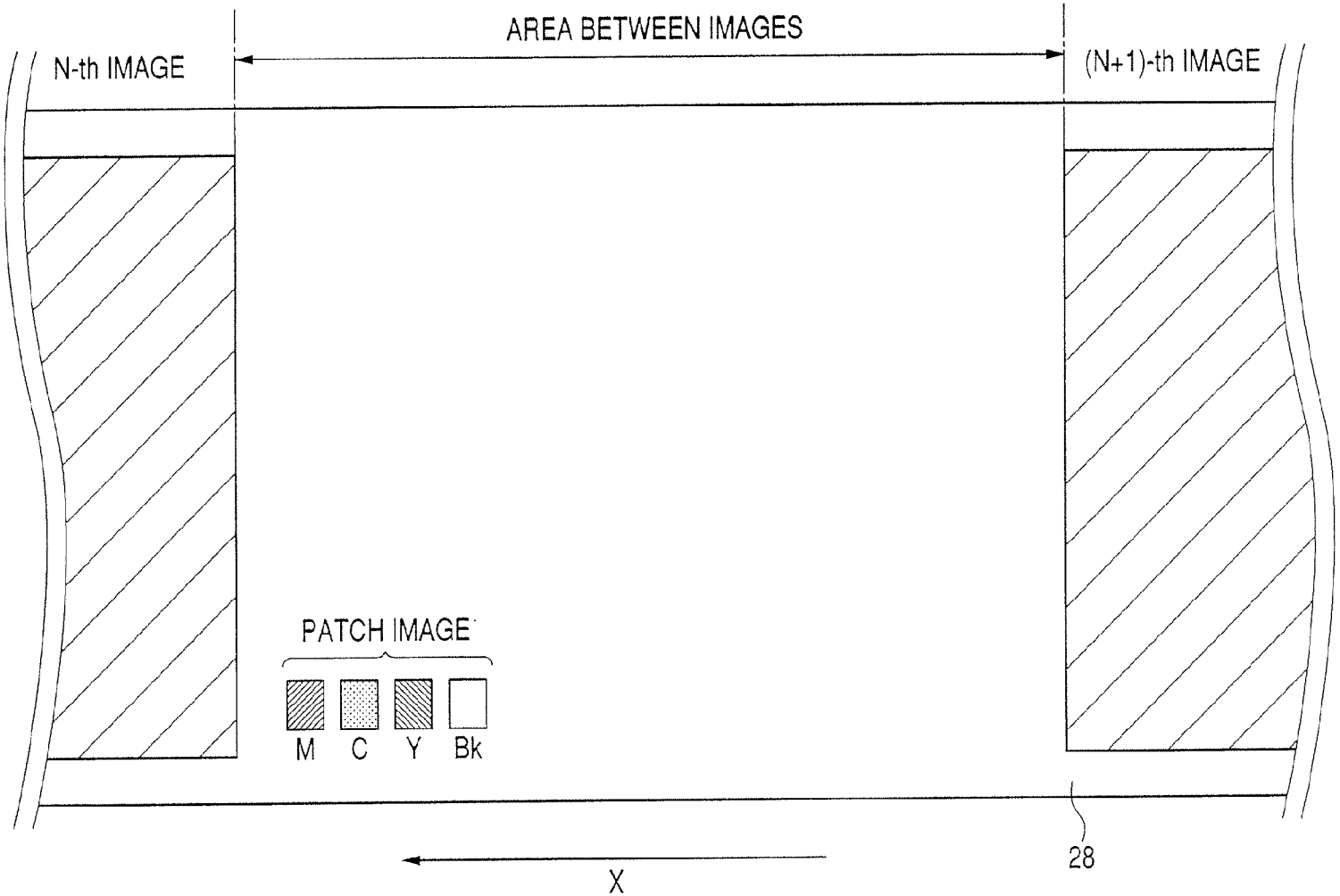
FIG. 3 is a schematic view showing a patch image formed in an inter-image area on an intermediate transfer member of the invention.

In the above-described configuration of the first embodiment, the density detection sensor 41 detects patch image density, CPU 54 which is of the controlling means determines whether the T/D ratio indicating the output signal is higher or lower than an optimum value of the T/D ratio which is previously set in initialization and stored in RAM 55, and the toner replenishment is performed. Namely, CPU 54 variably controls the T/D ratio (image forming condition) based on the patch image detection result of the density detection sensor 41. In the patch detection mode ATR, usually the correction is performed during post-rotation after the image forming action when the predetermined times of the image forming actions are completed, or the correction is performed at a frequency between the N-th image formation and the (N+1)-th image formation (i.e., between sheets) which are of the predetermined times of the image forming actions. As shown in FIG. 3, the patch image is formed on the intermediate transferring belt 28 and detected by the density detection sensor 41.

The four patch images are formed using the magenta toner, the cyan toner, the yellow toner, and the black toner, which are used for the image forming apparatus of the first embodiment, respectively.

The four patch images are arranged so as to be superposed in a proceeding direction of the intermediate transferring belt 28 (arrow X in FIG. 3) Namely, the patch image is formed in the inter-image area between the N-th image and the (N+1)-th image (toner image) on the intermediate transferring belt 28. When the patch image is formed in the inter-image area, after the patch image passes through the secondary transfer roller 26, a cleaning bias is applied to the secondary transfer roller 26 while the secondary transfer roller 26 is in contact with the inter-image area, and the patch image toner adhering to the secondary transfer roller 26 is removed. The cleaning bias will be described in detail later. In the first embodiment, letting N=100, the patch detection mode ATR correction is performed in each 100 prints. In the first embodiment, the secondary transfer roller 26 is also in contact with the inter-image area of the intermediate transferring belt 28, where the image (toner image) transferred to the recording material 8 does not exist.

The fog toner adheres to the inter-image area of the intermediate transferring belt 28. Therefore, even if the patch image is not formed in the inter-image area, the secondary transfer roller 26 is in contact with inter-image area, which causes the toner to adhere to the secondary transfer roller 26.

In the fog toner, the amount of toner per unit area is smaller than that of the patch image. However, when the many images are repeatedly formed, the toner adhering to the secondary transfer roller 26 causes the toner adhesion to the backside of the sheet (backside of the toner image transferred surface). Therefore, the cleaning bias is applied to the secondary transfer roller 26 in each predetermined times of the image formation to remove the fog toner adhering to the secondary transfer roller 26. At this point, setting the predetermined times of the image formation at M sheets, while the secondary transfer roller 26 is in contact with the inter-image area between the M-th image and the (M+1)-th image on the intermediate transferring belt 28, the cleaning bias is applied to the secondary transfer roller 26 to remove the fog toner adhering to the secondary transfer roller 26. The cleaning bias will be described in detail later. In the first embodiment, letting M=50, the fog toner adhering to the secondary transfer roller 26 is removed in each time when the prints are performed to 50 sheets.

Referring to FIGS. 4 to 7, a sequence view of the secondary transfer bias including the control in the first embodiment will be described below.

Figure 4:
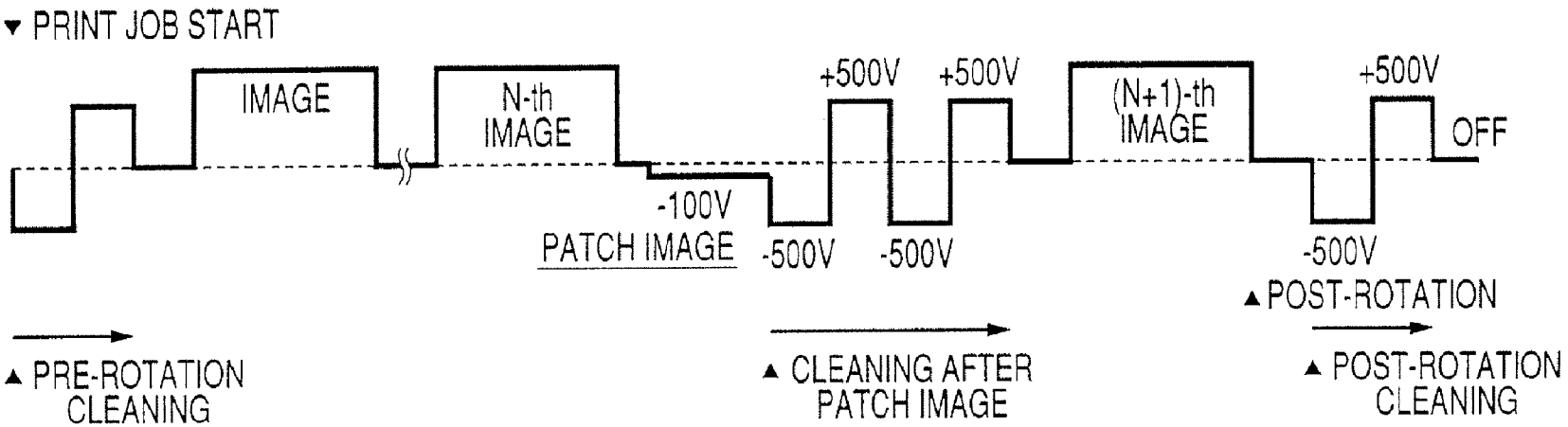
FIG. 4 is a sequence view of a secondary transfer bias when patch detection mode ATR correction is inserted during continuous image formation in the image forming apparatus of the invention.

FIG. 4 is a sequence view of the secondary transfer bias, when the patch detection mode ATR correction is inserted during the continuous image formation and the cleaning bias is applied while the secondary transfer roller 26 is in contact with the inter-image area in which the patch image is formed.

Figure 5:
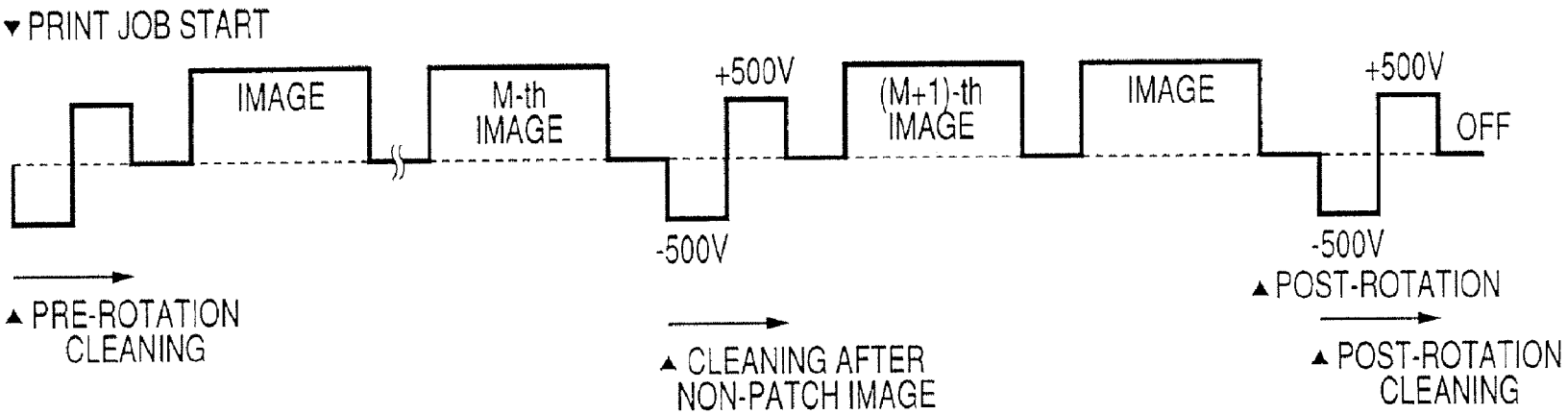
FIG. 5 is a sequence view of a secondary transfer bias when the patch detection mode ATR correction is not inserted but a cleaning bias is applied to a secondary transfer roller during the continuous image formation in the image forming apparatus of the invention.

FIG. 5 is a sequence view, when the patch detection mode ATR correction is not inserted during the continuous image formation and the cleaning bias is applied while the secondary transfer roller 26 is in contact with the inter-image area in which the patch image is not formed.

Figure 6:
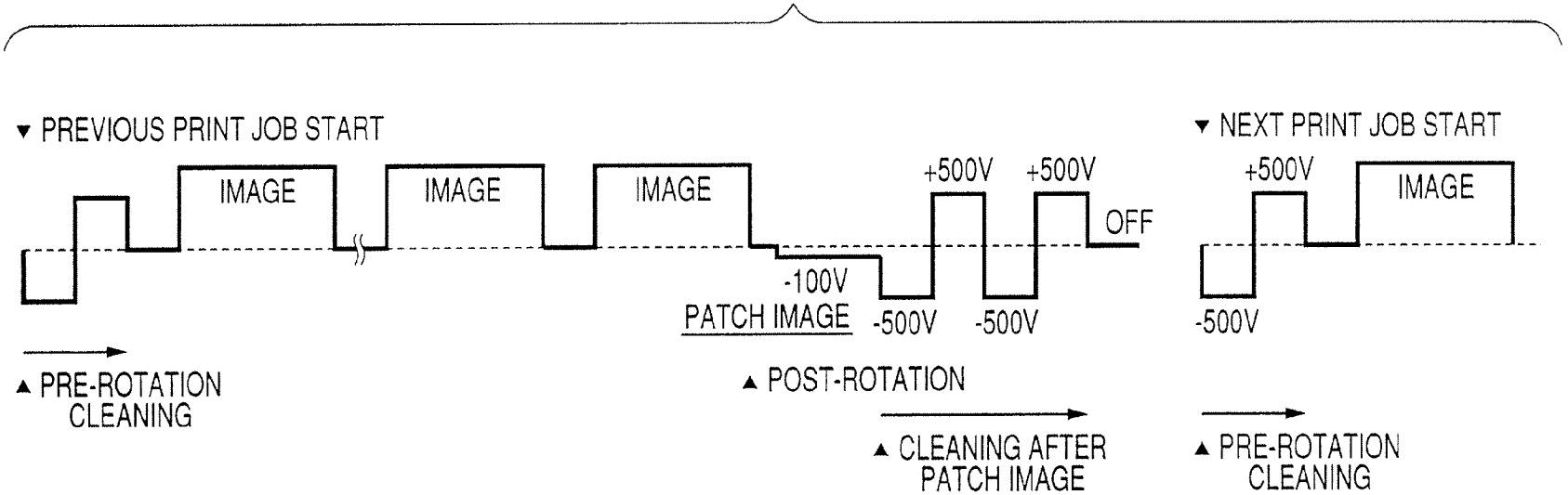
FIG. 6 is a sequence view of the secondary transfer bias of an embodiment when the patch detection mode ATR correction is inserted during post-rotation in the image forming apparatus of the invention.

FIG. 6 is a sequence view, when the patch detection mode ATR correction is inserted during post-rotation after the image forming action and the cleaning bias is not applied while the secondary transfer roller 26 is in contact with the inter-image area in which the patch image is not formed.

Figure 7:
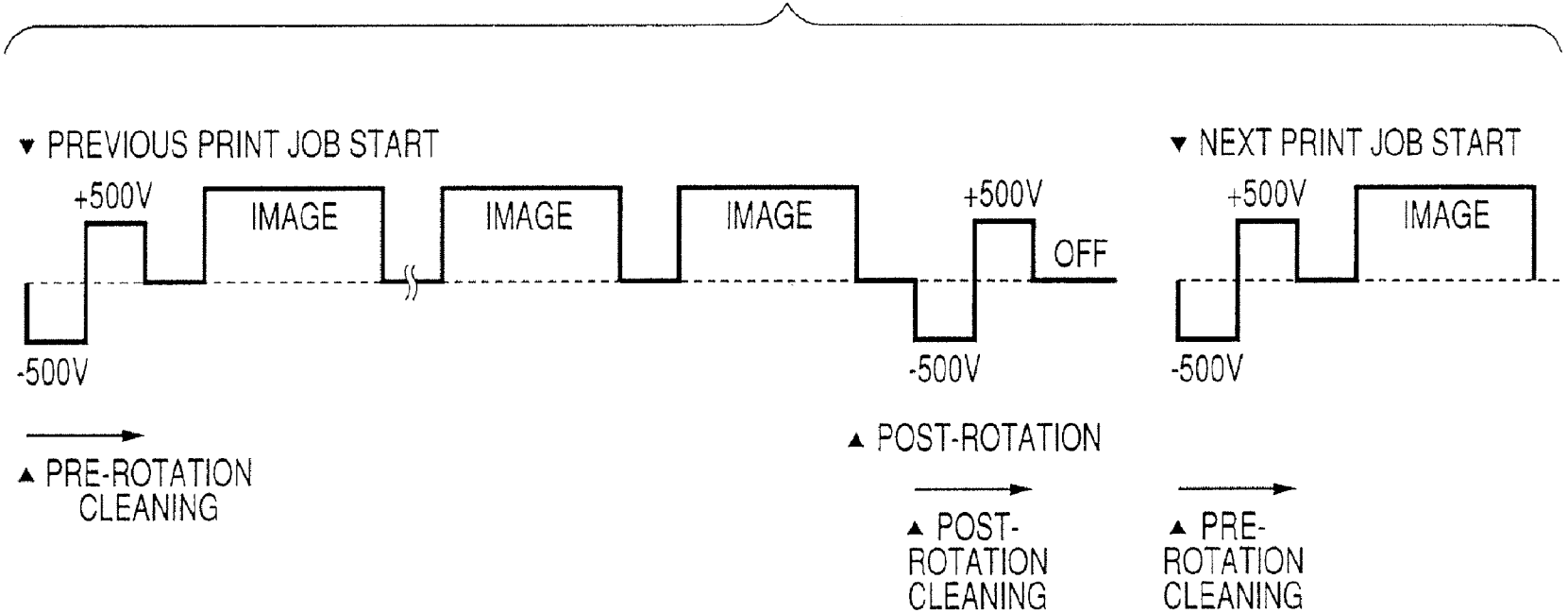
FIG. 7 is a sequence view of the secondary transfer bias when the patch detection mode ATR correction is not inserted in the image forming apparatus of the invention.

FIG. 7 is a sequence view, when the patch detection mode ATR correction is not inserted during post-rotation after the image forming action and the cleaning bias is not applied while the secondary transfer roller 26 is in contact with the inter-image area in which the patch image is not formed.

In the normal image formation of the first embodiment, as shown in FIG. 7, when the image forming action is started, in order to clean the secondary transfer roller 26 according to the pre-rotation of the photosensitive drum, the bias voltage of −500V having the opposite polarity to the transfer bias is applied to the secondary transfer roller 26 during one turn of the secondary transfer roller 26, and then the bias voltage of +500V having the polarity similar to the transfer bias is applied during one turn of the secondary transfer roller 26. Then, in synchronization with the image forming action, the transfer bias of about +2 KV is applied at timing in which the recording material 8 reaches the secondary transfer roller 26. The action, in which the transfer bias is tentatively turned off between the sheets and the application of the transfer bias is started again at the timing when the next recording material is coming, is repeated for the continuous image formation. After the final recording material passes through the secondary transfer roller 26, a post-rotation cleaning sequence is started. In the first embodiment, during the post-rotation, each voltage of −500V and +500V is applied during each one turn of the secondary transfer roller 26, and then the secondary transfer bias is turned off to end the post-rotation action.

Then, when the image formation of the next print job is started, in order to clean the secondary transfer roller 26 according to the pre-rotation of the photosensitive drum 21, the bias voltage of −500V having the opposite polarity to the transfer bias is applied to the secondary transfer roller 26 during one turn of the secondary transfer roller 26, and then the bias voltage of +500V having the polarity similar to the transfer bias is applied during one turn of the secondary transfer roller 26. Then, in synchronization with the image forming action, the transfer bias of about +2 KV is applied at the timing when the recording material 8 reaches the secondary transfer roller 26.

The transfer bias and the cleaning bias are not limited to the values shown in the first embodiment, but the transfer bias and the cleaning bias are appropriately changed according to the recording material, an environment, an endurance state, and the like.

As shown in FIG. 5, in the sequence in which the fog toner adhering to the secondary transfer roller 26 is cleaned between the sheets during the continuous image formation, each cleaning bias voltage of −500V and +500V is applied during each one turn of the secondary transfer roller 26 while the secondary transfer roller 26 is in contact with the inter-image area, and then the normal image forming action is repeated again at the timing in which the next recording material enters a secondary transfer roller nip portion. In the case where the patch action is not inserted during the post-rotation, as with the sequence shown in FIG. 6, the voltages of −500V and +500V are applied for a time in which the secondary transfer roller 26 is rotated by one turn, and then the secondary transfer bias is turned off to end the post-rotation action.

Further, as shown in FIG. 4, in the sequence in which the patch detection mode ATR correction is performed between the sheets during the continuous image formation, the bias voltage of −100V having the opposite polarity to the transfer bias is continuously applied to the secondary transfer roller 26 while the patch image passes through the secondary transfer roller nip portion, i.e. the contact portion between the secondary transfer roller 26 and the intermediate transferring belt 28, which prevents the contamination of the patch image to the secondary transfer roller 26 as much as possible. After the patch image passes through the secondary transfer roller nip portion, two sets of voltages of −500V and +500V are alternately applied for the time of each two turns of the secondary transfer roller 26, and then the normal image forming action is repeated again at the timing in which the next recording material enters the secondary transfer roller nip portion. In the case where the patch action is not inserted during the post-rotation, as with the sequence shown in FIG. 7, the voltages of −500V and +500V are applied for the time in which the secondary transfer roller 26 is rotated by one turn, and then the secondary transfer bias is turned off to end the post-rotation action.

Referring to FIG. 6, the sequence of the secondary transfer bias in the case where the patch detection mode ATR correction is inserted into the post-rotation will be described below.

As shown in FIG. 6, in the case where the patch detection mode ATR correction is inserted at the timing of the post-rotation in ending the image formation, as with the sequence between the sheets of FIG. 4, the bias voltage of −100V having the opposite polarity to the transfer bias is continuously applied to the secondary transfer roller 26 while the patch image passes through the secondary transfer roller nip portion, which prevents the contamination of the patch image to the secondary transfer roller 26 as much as possible. After the patch image passes through the secondary transfer roller nip portion, the two sets of voltages of −500V and +500V are applied for the time of each two turns of the secondary transfer roller 26. Then, in order to prevent the contamination of the main body by the toner adhering to the intermediate transferring belt 28, the cleaning apparatus 11 attached onto the intermediate transferring belt 28 cleans the adhesion toner re-transferred from the secondary transfer roller 26 to the intermediate transferring belt 28, and the post-rotation action is ended.

Then, when the image formation of the next print job is started, in order to clean the secondary transfer roller 26 according to the pre-rotation of the photosensitive drum 21, the bias voltage of −500V having the opposite polarity to the transfer bias is applied to the secondary transfer roller 26 during one turn of the secondary transfer roller 26, and then the bias voltage of +500V having the polarity similar to the transfer bias is applied during one turn of the secondary transfer roller 26. Then, in synchronization with the image forming action, the transfer bias of about +2 KV is applied at the timing when the recording material 8 reaches the secondary transfer roller 26.

Thus, the time, when the cleaning bias is applied to the secondary transfer roller 26 contacting the inter-image area in which the patch image is formed, is set longer than the time, when the cleaning bias is applied to the secondary transfer roller 26 contacting the inter-image area in which the patch image is not formed. Therefore, the toner adhering to the secondary transfer roller 26 can sufficiently be removed.

Further, the time, when the cleaning bias is applied to the secondary transfer roller 26 in the case where the patch image is formed on the intermediate transferring belt 28 at the timing of the post-rotation in ending the print job, is set longer than the time, when the cleaning bias is applied to the secondary transfer roller 26 in the case where the patch image is not formed in the intermediate transferring belt 28. Therefore, the toner adhering to the secondary transfer roller 26 can sufficiently be removed.

Namely, in the intermediate transferring belt 28, the time, when the cleaning bias applied to the secondary transfer roller 26 contacting the inter-image area between the final image of the previous print job and the initial image of the next print job in forming the toner patch image in the inter-image area, is set longer than the time, when the cleaning bias applied to the secondary transfer roller 26 contacting the inter-image area in the case where the toner patch image is not formed in the inter-image area. Therefore, the toner adhering to the secondary transfer roller 26 can sufficiently be removed.

Second Embodiment

Figure 8:
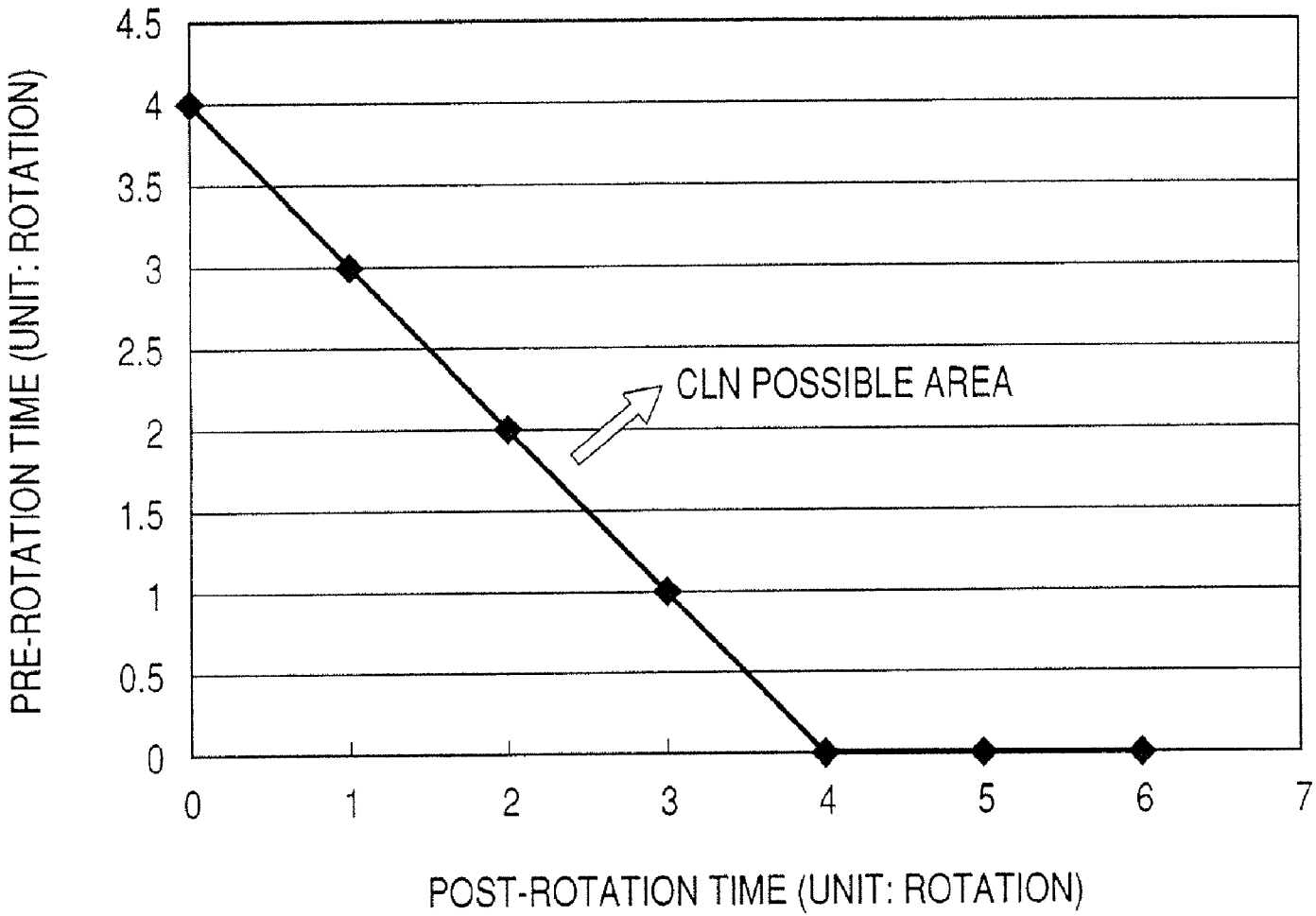
FIG. 8 is a graph showing study result of a cleaning time of the secondary transfer roller.

In the image forming apparatus described in the first embodiment, FIG. 8 shows the study result of the cleaning time of the secondary transfer roller 26 and a range where the contamination of the backside of the initially-entered recording material 8 is not detected when the cleaning time of the secondary transfer roller 26 is changed in the next pre-rotation after the patch detection mode ATR correction is inserted at the timing of the post-rotation in ending the image formation.

The study method is shown below.

As described in the first embodiment referring to FIG. 4, the bias voltage of −100V having the opposite polarity to the transfer bias is continuously applied to the secondary transfer roller 26 while the patch image passes through the secondary transfer roller nip portion, which prevents the contamination of the patch image to the secondary transfer roller 26 as much as possible. Then, after the patch image passes through the secondary transfer roller nip portion, the cleaning time of the secondary transfer roller 26 is changed in the post-rotation to end the post-rotation action.

Even in the secondary transfer roller 26 during the pre-rotation in starting the next image formation, after the cleaning time of the secondary transfer roller 26 is changed, the determination whether the backside contamination of the recording material 8 is generated or not is made.

A horizontal axis of FIG. 8 indicates a post-rotation cleaning time after the patch image passes through, and a vertical axis indicates the cleaning time in the pre-rotation. Unit is a time when the secondary transfer roller is rotated by one turn.

As a result of the study, as shown in FIG. 8, when the total time T2+T3 of the cleaning time T2 and the cleaning time T3 is set not shorter than a time T1 when the contamination of the secondary transfer roller 26 by the patch image is sufficiently cleaned, i.e. letting T1<=T2+T3, the contamination of the backside of the next-entered recording material 8 can be prevented. The time T2 means the cleaning time when the secondary transfer roller 26 is cleaned during the post-rotation after the patch image passes through, and the time T3 means the cleaning time when the secondary transfer roller 26 is cleaned during the pre-rotation.

Figure 9:
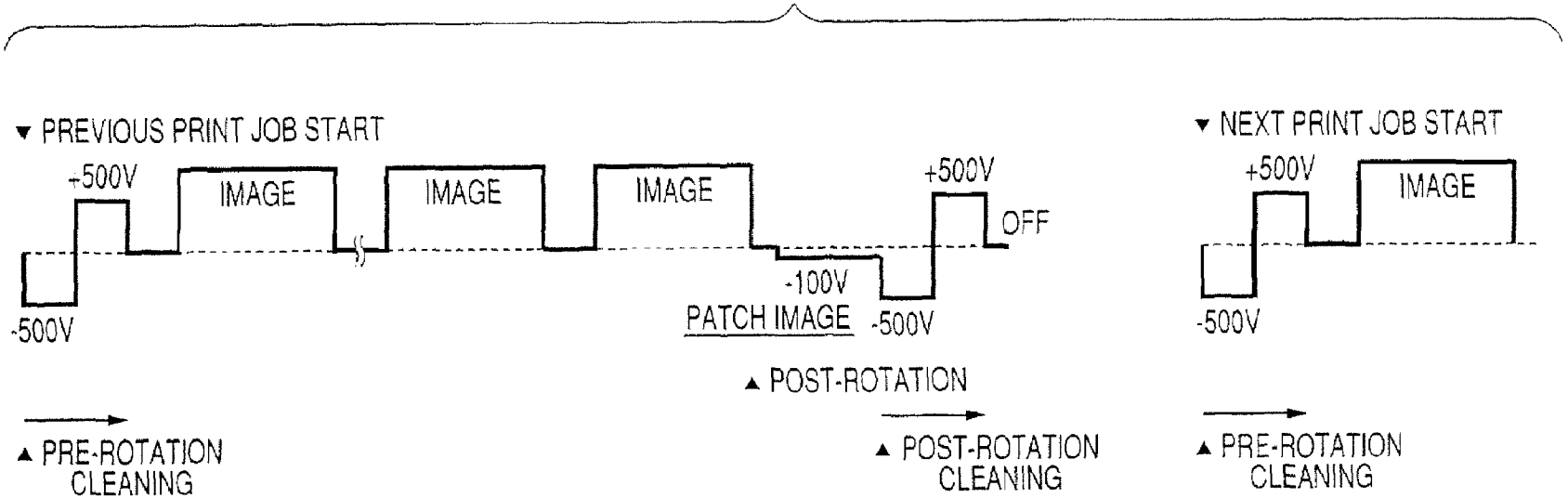
FIG. 9 is a sequence view of the secondary transfer bias of another embodiment when the patch detection mode ATR correction is inserted during the post-rotation in the image forming apparatus of the invention.

Accordingly, as shown in FIG. 9, when the patch detection mode ATR correction is inserted at the timing of the post-rotation in ending the image formation, as with the sequence between the sheets of FIG. 4, the bias voltage of −100V having the opposite polarity to the transfer bias is continuously applied to the secondary transfer roller 26 while the patch image passes through the secondary transfer roller nip portion, which prevents the contamination of the patch image to the secondary transfer roller 26 as much as possible. After the patch image passes through the secondary transfer roller nip portion, the voltages of −500V and +500V are applied for each one turn of the secondary transfer roller 26. Then, in order to prevent the contamination of the main body by the toner adhering to the intermediate transferring belt 28, the intermediate transferring belt 28 is rotated until the cleaning blade 11 attached onto the intermediate transferring belt 28 cleans the adhesion toner re-transferred from the secondary transfer roller 26 to the intermediate transferring belt 28, and the post-rotation action is ended. Even if the secondary transfer roller cleaning time is shortened in the post-rotation, because the secondary transfer cleaning action of each one turn of the secondary transfer roller 26 is always inserted in the next pre-rotation, the secondary transfer roller 26 can sufficiently be cleaned, and the backside contamination caused by the toner adhering to the secondary transfer roller 26 can be reduced.

Figure 10:
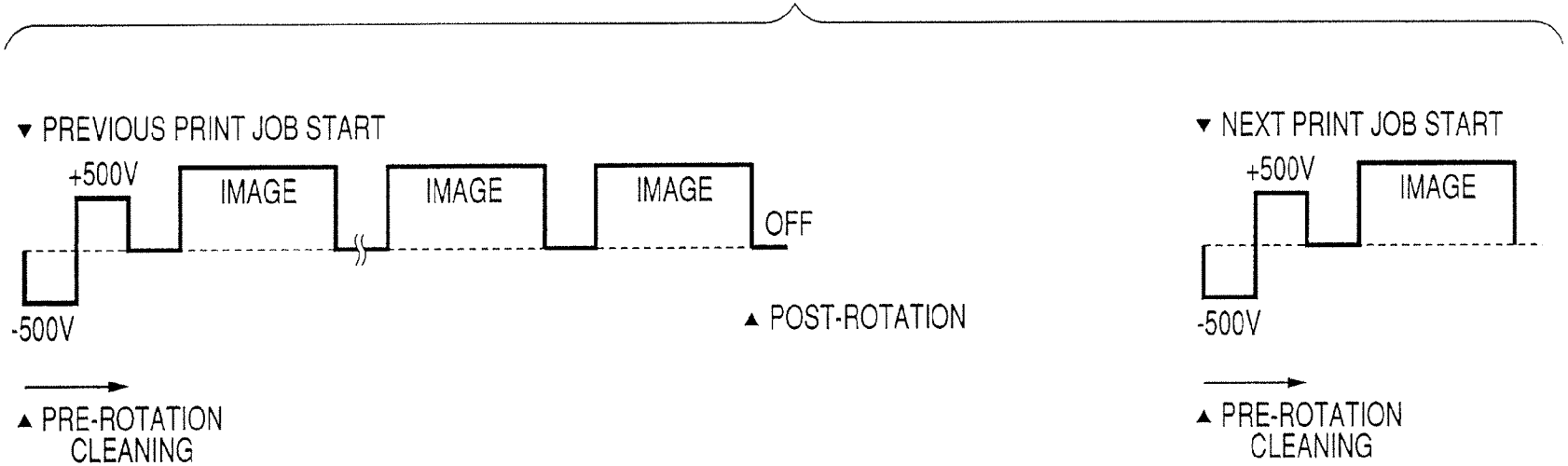
FIG. 10 is a sequence view of the secondary transfer bias of another embodiment when the patch detection mode ATR correction is not inserted during the post-rotation in the image forming apparatus of the invention.

FIG. 10 shows the sequence in the case where the patch detection mode ATR correction is not inserted at the timing of the post-rotation in ending the image formation in the second embodiment. In the second embodiment, the cleaning bias is not applied to the secondary transfer roller 26 in the post-rotation when the patch detection mode ATR correction is not inserted at the timing of the post-rotation in ending the image formation.

In the second embodiment, the time, when the cleaning bias is applied to the secondary transfer roller 26 in the case where the toner patch image is formed in the intermediate transferring belt 28 at the timing of the post-rotation in ending the print job, is also set longer than the time, when the cleaning bias is applied to the secondary transfer roller 26 in the case where the toner patch image is not formed in the intermediate transferring belt 28. Therefore, the toner adhering to the secondary transfer roller 26 can sufficiently be removed.

Namely, in the intermediate transferring belt 28, the time, when the cleaning bias applied to the secondary transfer roller 26 contacting the inter-image area between the final image of the previous print job and the initial image of the next print job in forming the toner patch image in the inter-image area, is set longer than the time, when the cleaning bias applied to the secondary transfer roller 26 contacting the inter-image area in the case where the toner patch image is not formed in the inter-image area. Therefore, the toner adhering to the secondary transfer roller 26 can sufficiently be removed.

Table 1 shows the study results of Examples 1, 2, and 3 of the second embodiment, Conventional Examples 1 and 2, and Comparative Example 1.

TABLE 1

| | | The number of revolutions | | | | Backside contamination | Backside contamination | |
|---|---|---|---|---|---|---|---|---|
| | Cleaning bias | After passing through the inter-sheet patch | Post-rotation after patch | Normal post-rotation | Pre-rotation | of recording material after inter-sheet patch | of recording material in starting image formation | Post-rotation time |
| Example 1 | +500 V/−500 v | two turns/two turns | two turns/two turns | one turn/one turn | one turn/one turn | ○ | ○ | ○ |
| Example 2 | +500 V/−500 v | two turns/two turns | One turn/one turn | One turn/one turn | One turn/one turn | ○ | ○ | ○ |
| Example 3 | +500 V/−500 v | Two turns/two turns | Zero turn/zero turn | Zero turn/zero turn | two turns/two turns | ○ | ○ | ◎ |
| Conventional Example 1 | +500 V/−500 v | One turn/one turn | one turn/one turn | one turn/one turn | One turn/one turn | X | ○ | ○ |
| Conventional Example 2 | +500 V/−500 v | Two turns/two turns | two turns/two turns | two turns/two turns | One turn/one turn | ○ | ○ | X |
| Comparative Example 1 | +3 KV/−3 KV | One turn/one turn | one turn/one turn | one turn/one turn | One turn/one turn | Δ | ○ | ○ |

◎; excellent,
○; good,
Δ; fair,
X; poor

As describe above, the cleaning of the secondary transfer roller 26 is not sufficient like Conventional Example 1 only by applying the cleaning bias for the time of one turn of the secondary transfer roller 26 after the patch image between the sheets passes through the secondary transfer roller 26, which causes the backside contamination to the next-entered recording material. Therefore, positive and negative biases are applied as the cleaning bias for not lower than the time of each two turns of the secondary transfer roller 26, which allows the backside contamination to be reduced.

Even if the bias value applied to the secondary transfer roller 26 is increased like Comparative Example 1, it is found that the effect is not changed too much, but the bias value for passing a transfer current more than a predetermined value is required.

The cleaning time in the post-rotation is not always set at one turn unit. In the case where the pre-rotation is short, the time in which the initial recording material reaches the secondary transfer portion is set at the pre-rotation cleaning time, and the time of T1-T3 is set at the secondary transfer roller cleaning time T2 of the post-rotation. Therefore, in the case where the patch image is formed in the post-rotation, the post-rotation time can be minimized without affecting a fast copy time.

Third Embodiment

Figure 11:
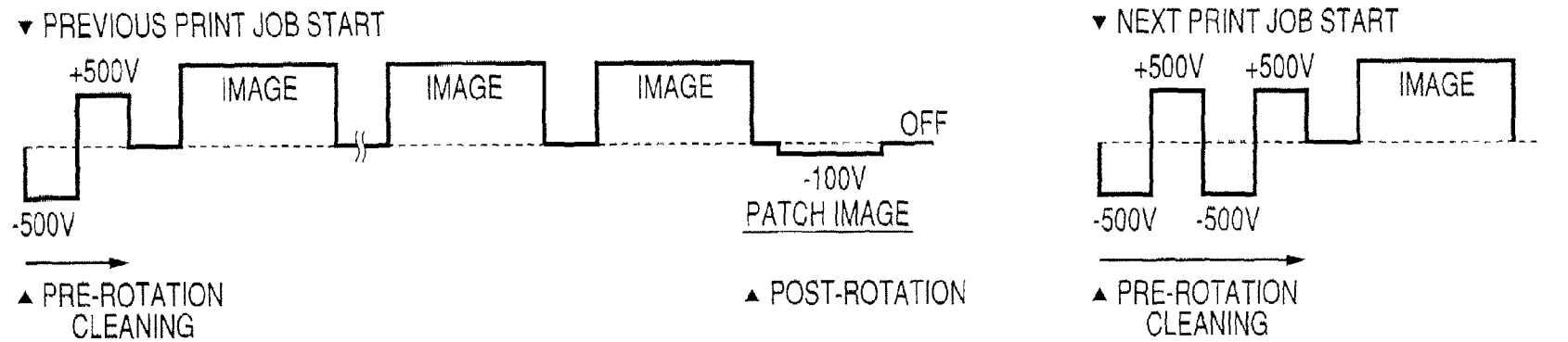
FIG. 11 is a sequence view of the secondary transfer bias of another embodiment when the patch detection mode ATR correction is inserted during the post-rotation in the image forming apparatus of the invention.

FIG. 11 shows a sequence of the secondary transfer bias according to a third embodiment of the invention. The third embodiment can also be implemented in the image forming apparatus described in the first embodiment, so that the description of the first embodiment is incorporated for the purpose of the description of the entire configuration of the image forming apparatus.

According to FIG. 8, in the third embodiment, during the post-rotation in ending the image formation, the post-rotation action is ended without cleaning the secondary transfer roller 26 in order to minimize the post-rotation time independently of the image control by the pattern image. During the normal post-rotation, the post-rotation action is also ended without cleaning the secondary transfer roller 26. In the pre-rotation in starting the next image formation, the two sets of voltages of −500V and +500V are applied for each two turns of the secondary transfer roller 26, and then the normal image forming action is repeated at the timing in which the recording material 8 enters the secondary transfer roller nip portion. Other sequences in the third embodiments are similar to the first embodiment and the second embodiment.

In the third embodiment, when the patch detection mode ATR correction is not inserted at the timing of the post-rotation after the image formation, the sequence shown in FIG. 10 is performed.

Thus, even if the cleaning action of the secondary transfer roller 26 in the post-rotation is neglected, the backside contamination to the recording material 8 can be prevented by performing the cleaning action for the rotating time not lower than each two turns of the positive and negative biases in the next pre-rotation.

In the third embodiment, in the intermediate transferring belt 28, the time, when the cleaning bias applied to the secondary transfer roller 26 contacting the inter-image area between the final image of the previous print job and the initial image of the next print job in forming the toner patch image in the inter-image area, is also set longer than the time, when the cleaning bias applied to the secondary transfer roller 26 contacting the inter-image area in the case where the toner patch image is not formed in the inter-image area. Therefore, the toner adhering to the secondary transfer roller 26 can sufficiently be removed.

Fourth Embodiment

Figure 12:
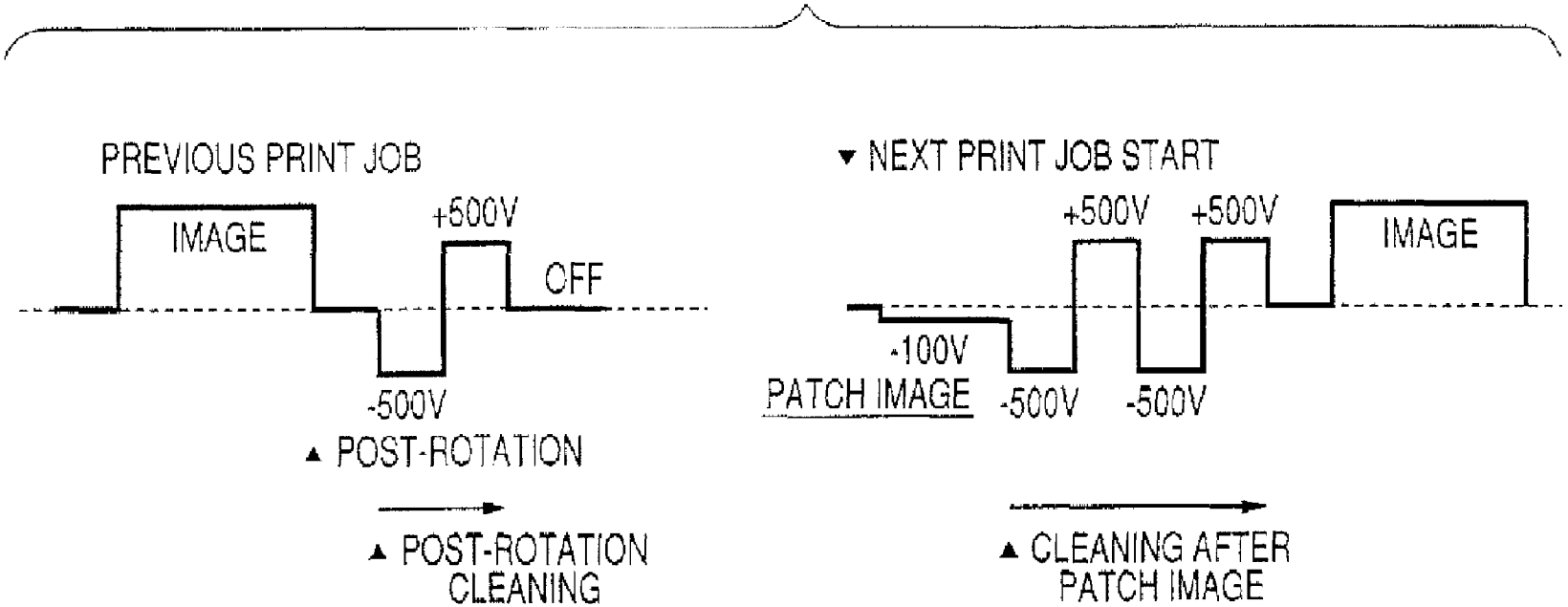
FIG. 12 is a sequence view of the secondary transfer bias when color drift control is inserted during pre-rotation in the image forming apparatus of the invention.

FIG. 12 shows a sequence of the secondary transfer bias according to a fourth embodiment of the invention. The fourth embodiment can also be implemented in the image forming apparatus described in the first embodiment, so that the description of the first embodiment is incorporated for the purpose of the description of the entire configuration of the image forming apparatus.

The fourth embodiment is the sequence performed in the pre-rotation, e.g. in the case where image information can already be outputted at the time when a user opens a door cover. At this point, in some sequences, after the user closes the door cover, a pattern image for preventing color drift is first formed on the intermediate transferring belt, the pattern image is detected by the density detection sensor 41 to perform drift control, and then the image forming action is continuously performed. In the color drift control, the image forming conditions are variably controlled to correct the color drift based on the detection result of the density detection sensor 41 on the pattern image for preventing color drift. The exposure conditions, such as exposure timing and an exposure position, for the photosensitive drum 21 of the exposing apparatus 80 are used as the image forming conditions.

Even in this case, as shown in FIG. 12, the bias voltage of −100V having the opposite polarity to the transfer bias is continuously applied to the secondary transfer roller 26 while the pattern image for preventing color drift (detection toner image) passes through the secondary transfer roller nip portion, which prevents the contamination of the pattern image to the secondary transfer roller 26 as much as possible. After the pattern image passes through the secondary transfer roller nip portion, the two sets of voltages of −500V and +500V are applied for each two turns of the secondary transfer roller 26. Then, the normal image forming action is repeated at the timing in which the recording material 8 continuously enters the secondary transfer roller nip portion. The sequences after the repetition of the image forming action are similar to the first embodiment.

Figure 13:
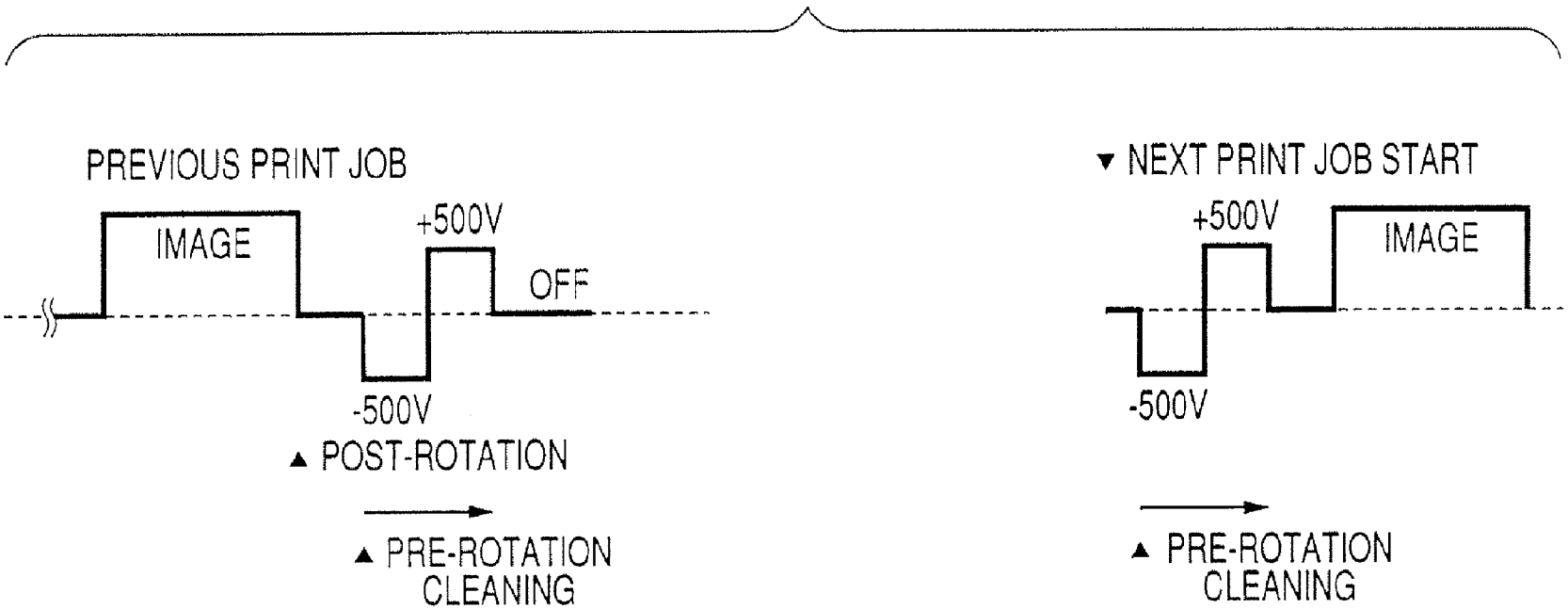
FIG. 13 is a sequence view of the secondary transfer bias when the color drift control is not inserted during pre-rotation in the image forming apparatus of the invention.

FIG. 13 shows a sequence in the case where the pattern image for preventing color drift is not formed in the pre-rotation in the fourth embodiment.

When the image forming action (print job) is started, in order to clean the secondary transfer roller 26 according to the pre-rotation of the photosensitive drum 21, the bias voltage of −500V having the opposite polarity to the transfer bias is applied to the secondary transfer roller 26 during one turn of the secondary transfer roller 26, and then the bias voltage of +500V having the polarity similar to the transfer bias is applied during one turn of the secondary transfer roller 26. Then, in synchronization with the image forming action, the transfer bias of about +2 KV is applied at the timing when the recording material 8 reaches the secondary transfer roller 26.

In the fourth embodiment, the time, when the cleaning bias is applied to the secondary transfer roller 26 in the case where the pattern image for preventing color drift is formed in the intermediate transferring belt 28 at the timing of the pre-rotation of the print job, is set longer than the time, when the cleaning bias is applied to the secondary transfer roller 26 in the case where the pattern image for preventing color drift is not formed in the intermediate transferring belt 28. Therefore, the toner adhering to the secondary transfer roller 26 can sufficiently be removed.

Fifth Embodiment

In the first embodiment to the fourth embodiment, the image forming apparatus of the invention is configured to have the intermediate transferring belt 28 as the intermediate transfer member. However, the invention is not limited to the image forming apparatus having the intermediate transferring belt 28.

Figure 14:
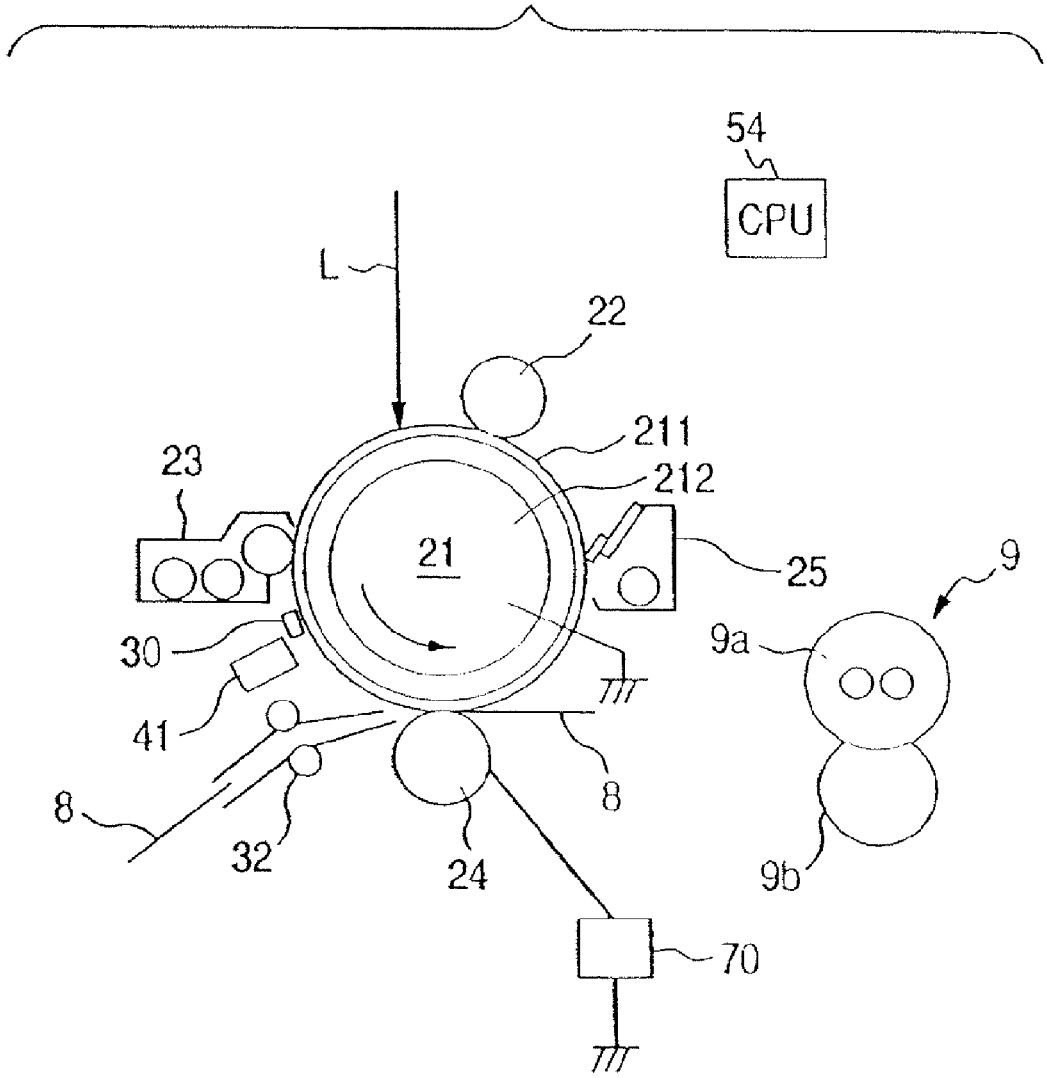
FIG. 14 is a schematic view showing another embodiment of the image forming apparatus of the invention.

FIG. 14 shows a schematic configuration of a fifth embodiment of the image forming apparatus of the invention. In the fifth embodiment, the image forming apparatus is the electrophotographic monochrome image forming apparatus such a copying machine and a printer, and the image forming apparatus includes the photosensitive drum 21 which is of the image bearing member rotatably arranged. The process instruments such as the charging apparatus 22, the developing apparatus 23, and the cleaning apparatus 25 are arranged around the photosensitive drum 21. The developer is accommodated in the developing apparatus 23.

A laser beam L (La, Lb, Lc, and Ld) having the image signal of the original is projected onto the photosensitive drum 21 through the polygon mirror (not shown), and the electrostatic latent image is formed on the photosensitive drum 21. The toner is supplied from the developing apparatus 23 to develop the electrostatic latent image, and the electrostatic latent image is visualized as the toner image. The photosensitive drum 21 has the configuration in which a photosensitive layer 211 is provided on the surface of a metal roller 212, and the metal roller 212 is electrically grounded.

When the toner image visualized on the photosensitive drum 21 reaches the transfer portion, the bias is applied from the power supply 70 to the transfer roller 24 which is the transfer means to which the transfer bias is applied. Therefore, the toner image is transferred onto the recording material 8 which is conveyed in synchronization with the toner image. Finally the recording material 8 is separated from the photosensitive drum 21, and the toner image is fixed onto the recording material 8 by the fixing apparatus 9.

The adhesion toner remaining on the photosensitive drum 21 is cleaned by the cleaning apparatus 25.

In the image forming apparatus having the above configuration, the transfer roller 24 which is of the transfer member is rotated wile being in contact with the photosensitive drum 21, and a density detection pattern image 30 which is formed on the photosensitive drum 21 in order to control the image adheres directly to the surface of the transfer roller 24 at the transfer nip portion.

In the image forming apparatus of the fifth embodiment, the density of the image pattern is detected on the photosensitive drum 21 by the density detection sensor 41 arranged between the developing apparatus 23 and the transfer roller 24, which performs the image control such as toner replenishment control.

The fifth embodiment has the completely same sequences to the transfer roller 24 as for the cleaning of the secondary transfer roller 26 in the first to fourth embodiments, i.e. the sequences shown in FIG. 4 to 7 and FIGS. 9 to 12 are performed in the fifth embodiment. Therefore, the same effects as for the first to fourth embodiments can be obtained, the backside contamination by the transfer roller 24 can be reduced, and the time necessary for the post-rotation can be shortened.

In the first to fifth embodiments, the two sets of bias voltages of +500V and −500V are applied to the secondary transfer roller 26 which is in contact with the inter-image area for the time of each two turns of the secondary transfer roller 26 when the patch image is formed in the inter-image area, and the bias voltages of +500V and −500V are applied to the secondary transfer roller 26 which is in contact with the inter-image area for the time of each one turn of the secondary transfer roller 26 when the patch image is not formed in the inter-image area.

Figure 15:
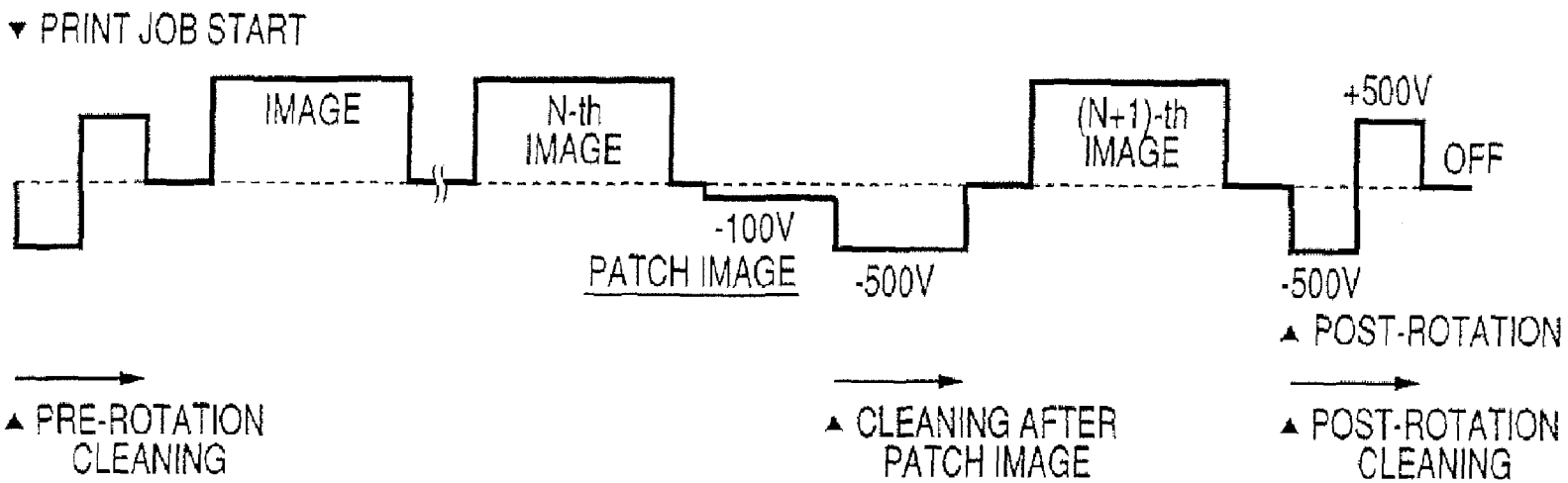
FIG. 15 is another sequence view of the secondary transfer bias when the patch detection mode ATR correction is inserted during the continuous image formation in the image forming apparatus of the invention.
Figure 16:
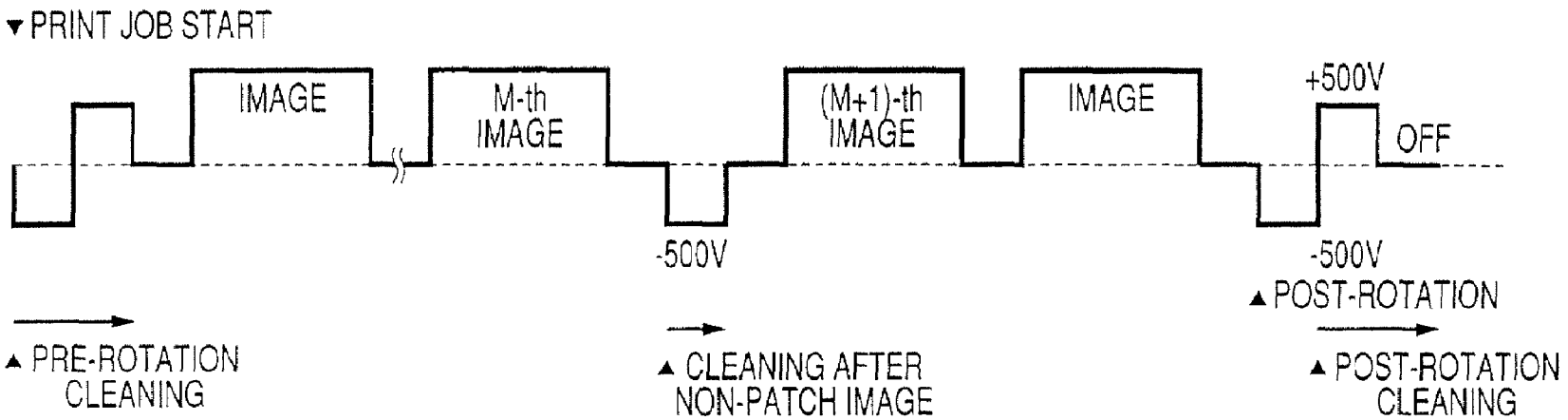
FIG. 16 is another sequence view of the secondary transfer bias when the patch detection mode ATR correction is not inserted but the cleaning bias is applied to the secondary transfer roller during the continuous image formation in the image forming apparatus of the invention.

Alternatively, the bias voltage of −500V is applied to the secondary transfer roller 26 which is in contact with the inter-image area for the time of two turns of the secondary transfer roller 26 when the patch image is formed in the inter-image area as shown in FIG. 15 by way of example, and the bias voltage of −500V is applied to the secondary transfer roller 26 which is in contact with the inter-image area for the time of one turn of the secondary transfer roller 26 when the patch image is not formed in the inter-image area as shown in FIG. 16 by way of example.

This application claims priority from Japanese Patent Application No. 2004-180228 filed on Jun. 17, 2004, which is hereby incorporated by reference herein.

What is claimed is:

1. An image forming apparatus comprising:

an image bearing member;

toner image forming means for repeatedly forming a plurality of toner images on said image bearing member, said toner image forming means forming a detection patch in an inter-toner image area on said image bearing member;

a transfer member which contacts said image bearing member to form a transfer nip portion, said transfer member electrically transferring the toner image formed on said image bearing member to the recording material in the transfer nip portion;

detecting means for detecting the detection patch on said image bearing member;

controlling means for variably controlling a toner image forming condition of said toner image forming means based on the detection result of said detecting means; and toner removing means for forming a cleaning electric field to remove toner adhering to said transfer member when the inter-toner image area passes through the transfer nip portion, the cleaning electric field electrostatically moving the toner adhering to said transfer member to said image bearing member, wherein a length of time of the cleaning electric field formed in a time period when the inter-toner image area on which the detection patch is formed passes through the transfer nip portion, is longer than a length of time of the cleaning electric field formed in a time period when the inter-toner image area on which the detection patch is not formed passes through the transfer nip portion.

2. An image forming apparatus according to claim 1, wherein the transfer member includes a roller, wherein the transfer is rotated by at least two turns while the cleaning electric field is formed in the time period when the inter-toner image area on which the detection patch is formed passes through the transfer nip portion, and wherein the transfer is rotated by at least one turn while the cleaning electric field is formed in the length of time when the inter-toner image area on which the detection patch is not formed passes through the transfer nip portion.

3. An image forming apparatus according to claim 2, wherein said toner image forming means forms the toner image using a plurality of colors of the toner, and said toner image forming means forms a plurality of detection patches using the plurality of colors of the toner.

4. An image forming apparatus according to claim 3, further comprising a power supply which applies a voltage having a predetermined polarity when said transfer member transfers the toner image on said image bearing member to the recording material, wherein said power supply applies the voltage having an opposite polarity to the predetermined polarity to said transfer member when the detection patch is in the transfer nip portion.

* * * * *

UNITED STATES PATENT AND TRADEMARK OFFICE

CERTIFICATE OF CORRECTION

PATENT NO. : 7,366,438 B2
APPLICATION NO. : 11/735759
DATED : April 29, 2008
INVENTOR(S) : Yasushi Takeuchi et al.

It is certified that error appears in the above-identified patent and that said Letters Patent is hereby corrected as shown below:

COLUMN 1
Line 66, “remove” should read --removing--.

COLUMN 4
Line 34, “portion” should read --portion,--.
Lines 37-56 should be deleted.

COLUMN 6
Line 51, “41 which” should read --which--.

COLUMN 7
Line 39, “with” should read --with the--.
Line 49, “times” should read --time--.

COLUMN 9
Line 64, “time,” should read --time--.
Line 67, “time,” should read --time--.

COLUMN 10
Line 5, “time,” should read --time--.
Line 9, “time,” should read --time--.
Line 14, “time,” should read --time--.
Line 19, “time,” should read --time--.

COLUMN 12
Line 4, “time,” should read --time--.
Line 8, “time,” should read --time--.
Line 15, “time,” should read --time--.
Line 20, “time,” should read --time--.
Line 63, “describe” should read --described--.

COLUMN 13
Line 58, “time,” should read --time--.
Line 63, “time,” should read --time--.

UNITED STATES PATENT AND TRADEMARK OFFICE

CERTIFICATE OF CORRECTION

PATENT NO. : 7,366,438 B2
APPLICATION NO. : 11/735759
DATED : April 29, 2008
INVENTOR(S) : Yasushi Takeuchi et al.

It is certified that error appears in the above-identified patent and that said Letters Patent is hereby corrected as shown below:

COLUMN 14

Line 58, “time,” should read --time--.
Line 62, “time,” should read --time--.

COLUMN 15

Line 13, “such” should read --such as--.
Line 39, “Finally” should read --Finally,--.

Signed and Sealed this

Eighteenth Day of November, 2008

JON W. DUDAS
*Director of the United States Patent and Trademark Office*